US012638176B2

(12) United States Patent
Enomoto

(10) Patent No.: US 12,638,176 B2
(45) Date of Patent: May 26, 2026

(54) VACUUM PUMP, DETOXIFYING DEVICE, AND EXHAUST GAS PROCESSING SYSTEM

(71) Applicant: Edwards Japan Limited, Yachiyo (JP)

(72) Inventor: Yoshihiro Enomoto, Yachiyo (JP)

(73) Assignee: Edwards Japan Limited, Yachiyo (JP)

( * ) Notice: Subject to any disclaimer, the term of this patent is extended or adjusted under 35 U.S.C. 154(b) by 814 days.

(21) Appl. No.: 17/796,692

(22) PCT Filed: Feb. 12, 2021

(86) PCT No.: PCT/JP2021/005364
§ 371 (c)(1),
(2) Date: Aug. 1, 2022

(87) PCT Pub. No.: WO2021/166815
PCT Pub. Date: Aug. 26, 2021

(65) Prior Publication Data

US 2023/0056826 A1 Feb. 23, 2023

(30) Foreign Application Priority Data

Feb. 21, 2020 (JP) ..... 2020-028707

(51) Int. Cl.

| | |
|---|---|
| ***F23G 7/06*** | (2006.01) |
| ***F04D 19/04*** | (2006.01) |
| *F23J 15/02* | (2006.01) |
| *F23J 15/04* | (2006.01) |

(52) U.S. Cl.
CPC ..... *F23G 7/065* (2013.01); *F04D 19/042* (2013.01); *F23G 2207/40* (2013.01); *F23G 2209/14* (2013.01); *F23J 15/022* (2013.01); *F23J 15/04* (2013.01)

(58) Field of Classification Search
None
See application file for complete search history.

(56) References Cited

U.S. PATENT DOCUMENTS

| | | | |
|---|---|---|---|
| 5,443,368 | A | 8/1995 | Weeks et al. |
| 7,543,492 | B2 | 6/2009 | Becourt |
| 2003/0219342 | A1 | 11/2003 | Curry et al. |

(Continued)

FOREIGN PATENT DOCUMENTS

| | | | |
|---|---|---|---|
| EP | 2264558 | A2 | 12/2010 |
| JP | H07246529 | A | 9/1995 |
| JP | 2003129957 | A | 5/2003 |

(Continued)

OTHER PUBLICATIONS

English translation of JP 2012057192A.*

(Continued)

*Primary Examiner* — Jason Lau
(74) *Attorney, Agent, or Firm* — Shumaker & Sieffert, P.A.

(57) ABSTRACT

Provided is a vacuum pump that can realize energy conservation when performing abatement of exhaust gas.

A vacuum pump that sucks in and exhausts exhaust gas includes a motor serving as a drive source, and a first controller that controls driving of the motor. The first controller monitors a state of the motor, and in a case in which the state of the motor is a specific state excluding when starting up and when stopped, outputs a specific signal (process signal) to an external entity.

4 Claims, 8 Drawing Sheets

(56) References Cited

U.S. PATENT DOCUMENTS

| | | | |
|---|---|---|---|
| 2014/0352820 | A1 | 12/2014 | Nakazawa et al. |
| 2018/0207580 | A1 | 7/2018 | Nakazawa et al. |

FOREIGN PATENT DOCUMENTS

| | | | | | |
|---|---|---|---|---|---|
| JP | 2012057192 | A | * | 3/2012 | |
| JP | 2014231822 | A | * | 12/2014 | ..... B01D 53/74 |

OTHER PUBLICATIONS

International Search Report and Written Opinion of International Application No. PCT/JP2021/005364 dated Apr. 27, 2021, 10 pp.
Extended Search Report from counterpart European Application No. 21756684.3 dated Jun. 4, 2024, 10 pp.
First Office Action and Search Report, and partial translation thereof, from counterpart Chinese Application No. 202180013905.0 dated Aug. 26, 2025, 12 pp.
Office Action, and translation thereof, from counterpart Korean Application No. 102022702591 dated Sep. 16, 2025, 11 pp.
Written Opinion from counterpart Singapore Application No. 11202252229J dated Feb. 6, 2026, 8 pp.

* cited by examiner

VACUUM PUMP, DETOXIFYING DEVICE, AND EXHAUST GAS PROCESSING SYSTEM

This application is a U.S. national phase application under 35 U.S.C. § 371 of international application number PCT/JP2021/005364 filed on Feb. 12, 2021, which claims the benefit of JP application number 2020-028707 filed on Feb. 21, 2020. The entire contents of each of international application number PCT/JP2021/005364 and JP application number 2020-028707 are incorporated herein by reference.

TECHNICAL FIELD

The present disclosure relates to a vacuum pump, an abatement device, and an exhaust gas treatment system.

BACKGROUND

Exhaust gas exhausted from semiconductor manufacturing devices and so forth contains harmful substances, and accordingly the exhaust gas needs to be rendered harmless by an abatement device.

For example, Japanese Patent Application Publication No. 2015-194150 discloses controlling operation of an abatement device on the basis of output electric power of an inverter that drives a motor of a vacuum pump. According to Japanese Patent Application Publication No. 2015-194150, stopping or resuming operations of the abatement device in accordance with whether output of the inverter is above or below a threshold value enables energy conservation to be realized.

SUMMARY

However, when control is performed for operating the abatement device in accordance with the output of the inverter of the vacuum pump alone as described in Japanese Patent Application Publication No. 2015-194150, operations of the abatement device will be stopped or resumed in cases of increase or decrease of electric power during acceleration, deceleration, or the like, of the motor. Accordingly, Japanese Patent Application Publication No. 2015-194150 has room for improvement from the perspective of energy conservation.

With the foregoing in view, it is an object of the present disclosure to provide a vacuum pump, an abatement device, and an exhaust gas treatment system, which are capable of realizing energy conservation when performing abatement of exhaust gas.

In order to achieve the above object, an aspect of the present disclosure is a vacuum pump that draws in, e.g., sucks in and exhausts exhaust gas, the vacuum pump including: a motor serving as a drive source; and a first controller that controls driving of the motor. The first controller monitors a state of the motor, and in a case in which the state of the motor is a specific state, which in some examples excludes when starting up and when stopped, outputs a specific signal to an external entity.

Also, in the above configuration, the specific state preferably is a state in which the motor is in normal operations and a current of the motor exceeds a predetermined threshold value.

Also, in the above configuration, the first controller preferably outputs the specific signal to the external entity while the motor is in normal operations and the current of the motor exceeds the predetermined threshold value, and maintains output of the specific signal to the external entity until a predetermined amount of time elapses after the current of the motor becomes no greater than the predetermined threshold value.

Also, in the above configuration, the predetermined amount of time is preferably set to an amount of time exceeding an amount of time for the exhaust gas exhausted from the vacuum pump to reach an abatement device installed on a downstream side of the vacuum pump.

Also, in the above configuration, the external entity preferably is a second controller that controls actions of the abatement device.

Also, in the above configuration, the first controller preferably forbids output of the specific signal to the external entity until a specific amount of time elapses from a point in time at which the motor starts and reaches normal operations.

In order to achieve the above object, another aspect of the present disclosure is an abatement device that is installed in a system in which exhaust gas exhausted from a plurality of vacuum pumps is collected, and performs abatement of the exhaust gas exhausted from the plurality of vacuum pumps, the abatement device including: a combustion furnace that performs combustion of the exhaust gas; a solenoid valve that opens and closes to supply fuel gas to the combustion furnace; and a second controller that controls opening and closing actions of the solenoid valve. The second controller controls an opening degree of the solenoid valve on the basis of a total count of signals input from the plurality of vacuum pumps.

In order to achieve the above object, another aspect of the present disclosure is an abatement device that is installed in a system in which exhaust gas exhausted from a plurality of vacuum pumps is collected, and performs abatement of the exhaust gas exhausted from the plurality of vacuum pumps, the abatement device including: a combustion furnace that performs combustion of the exhaust gas; a solenoid valve that opens and closes to supply fuel gas to the combustion furnace; and a second controller that controls opening and closing actions of the solenoid valve. The second controller controls an opening degree of the solenoid valve on the basis of a total value of motor currents input from the plurality of vacuum pumps.

In order to achieve the above object, another aspect of the present disclosure is an exhaust gas treatment system including: a vacuum pump that sucks in and exhausts exhaust gas; and an abatement device that performs abatement of the exhaust gas exhausted from the vacuum pump. The vacuum pump includes a motor serving as a drive source, and a first controller that controls driving of the motor. The abatement device includes a combustion furnace that performs combustion of the exhaust gas, a solenoid valve that opens and closes to supply fuel gas to the combustion furnace, and a second controller that controls opening and closing actions of the solenoid valve. The first controller monitors a state of the motor, and in a case in which the state of the motor is a specific state excluding when starting up and when stopped, outputs a specific signal to the second controller. The second controller controls opening and closing of the solenoid valve on the basis of the specific signal from the first controller.

According to the present disclosure, energy conservation can be realized when performing abatement of exhaust gas. Note that issues, configurations, and advantages other than those described above will become clear from the following description of examples.

DETAILED DESCRIPTION

Examples of the present disclosure will be described below with reference to the Figures.

First Example

Figure 1:
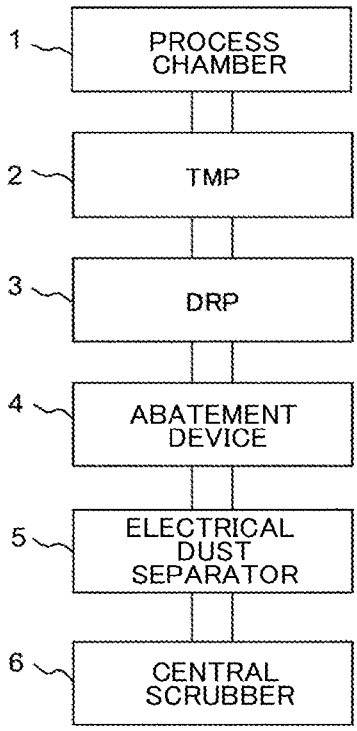
FIG. 1 is an overall configuration diagram of an exhaust gas treatment system according to a first example of the present disclosure.

FIG. 1 is an overall configuration diagram of an exhaust gas treatment system according to a first example of the present disclosure. The exhaust gas treatment system illustrated in FIG. 1 is used to render harmless exhaust gasses (process gas, cleaning gas) exhausted from a process chamber 1 such as, for example, a semiconductor manufacturing device, a flat panel display manufacturing device, a solar panel manufacturing device, or the like.

In the process chamber 1, chemical vapor deposition (CVD) processing in which chemical gas-phase reaction is used for film formation, etching processing, and so forth (hereinafter, referred to as "process processing"), is performed, and various types of gasses are used in the process chamber 1. Examples of these gasses include silane ($SiH_4$), $NH_3$, and $H_2$, which are film-forming material gasses for semiconductor devices, liquid crystal panels, and solar cells, gaseous fluorides such as $NF_3$, $CF_4$, $C_2F_6$, $SF_6$, $CHF_3$, $CF_6$, and so forth, which are used as cleaning glasses for performing plasma cleaning of inside of a process chamber of a plasma CVD device or the like, and inert gasses such as nitrogen ($N_2$), for example.

A turbomolecular pump (TMP) 2 that is an example of a vacuum pump is connected to the process chamber 1 so as to draw to a vacuum in order to remove these harmful exhaust gasses, and a dry pump (DRP) 3 is serially connected to the turbomolecular pump 2 on a downstream side of this turbomolecular pump 2. At the time of removing the exhaust gas from the process chamber 1, the process chamber 1 is first drawn to a vacuum to a certain degree by the dry pump 3 at the time of starting operations, following which the process chamber 1 is further drawn to a low pressure by the turbomolecular pump 2. Note that a rotary pump may be used instead of the dry pump 3, and depending on the specifications of the exhaust gas treatment system, the dry pump 3 may be entirely omitted.

The harmful exhaust gas discharged from the process chamber 1 via the turbomolecular pump 2 and the dry pump 3 is subjected to combustion decomposition at an abatement device 4, and to electrical dust separation at an electrical dust separator 5, and thereafter reaches a central scrubber 6. At this time, the exhaust gas is guided into the abatement device 4 and the electrical dust separator 5 under a certain amount of depressurization by the central scrubber 6. Note that there are cases in which the abatement device 4 and the electrical dust separator 5 are configured as a single device.

Next, out of the devices making up the exhaust gas treatment system, the turbomolecular pump 2 and the abatement device 4 in particular will be described in detail. Note that the configurations of the electrical dust separator 5 and the central scrubber 6 are known, and accordingly detailed description will be omitted.

Figure 2:
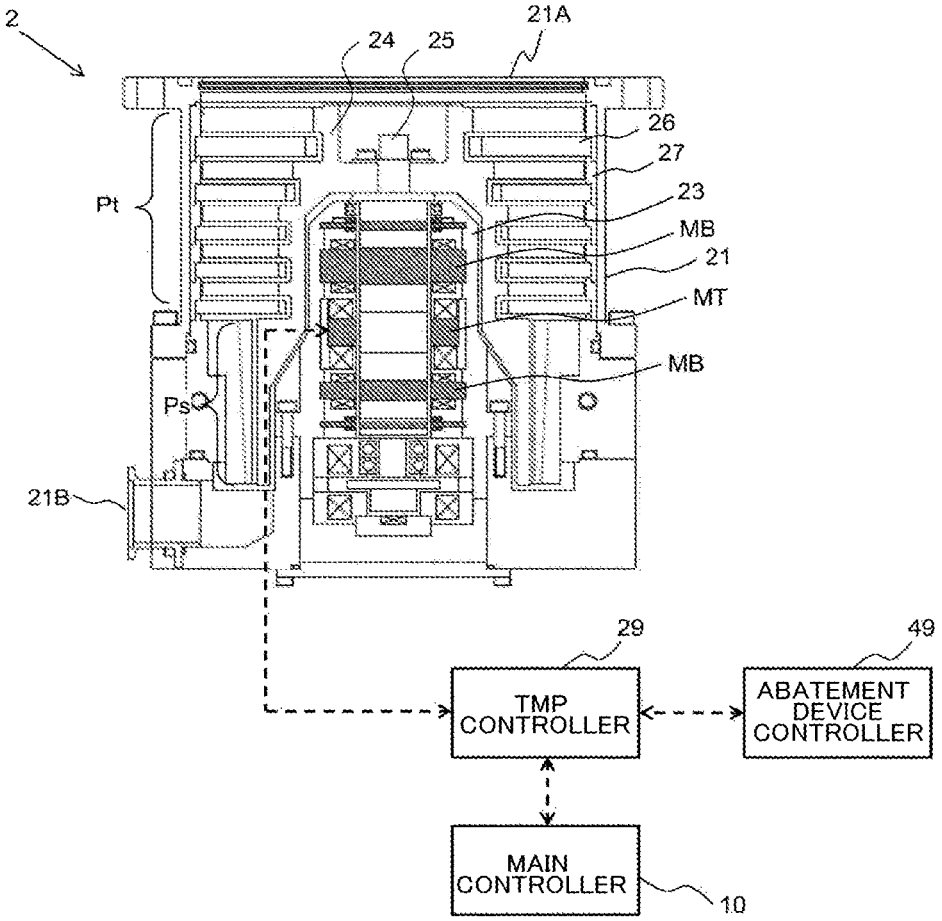
FIG. 2 is a cross-sectional view illustrating an internal configuration of a turbomolecular pump.

FIG. 2 is a cross-sectional view illustrating an internal configuration of the turbomolecular pump 2. As illustrated in FIG. 2, the turbomolecular pump 2 is a combination pump including a turbomolecular pump mechanism portion Pt and a thread groove pump mechanism portion Ps, serving as a gas exhausting mechanism, for example. A stator column 23 is erected within a casing 21. A rotating body 24 is disposed on an outer side of the stator column 23. Also, built in on an inner side of the stator column 23 are various types of electrical components, such as magnetic bearings MB serving as supporting means supporting the rotating body 24 in a radial direction and an axial direction thereof, a motor MT serving as a drive source (driving means) rotationally driving the rotating body 24, and so forth.

A rotating shaft 25 is disposed on an inner side of the rotating body 24, and the rotating shaft 25 is located on the inner side of the stator column 23 and is integrally fastened to the rotating body 24. In this structure, supporting the rotating shaft 25 by the magnetic bearings MB rotatably supports the rotating body 24 at a predetermined position in the axial direction and the radial direction thereof. Also, in this structure, rotating the rotating shaft 25 by the motor MT rotationally drives the rotating body 24 about a center of rotation thereof (specifically, a center of the rotating shaft 25). A plurality of rotor blades 26 is provided on an outer circumferential face of the rotating body 24, and a plurality of stator blades 27 is provided on an inner circumferential face of the casing 21, at positions corresponding to the plurality of rotor blades 26.

Thus, the turbomolecular pump 2 sucks, e.g., draws in, the above exhaust gas from an inlet port 21A by rotation of the rotating body 24, and externally exhausts the extracted exhaust gas from an outlet port 21B.

Driving of the above motor MT is controlled by a turbomolecular pump controller 29 (hereinafter referred to as "TMP controller 29"). The TMP controller 29 (first controller) is electrically connected to a main controller 10 that controls the entire exhaust gas treatment system, and an abatement device controller 49 (second controller) that controls the abatement device 4. Note that the TMP controller 29 and the abatement device controller 49 may be integrally configured.

The TMP controller 29 controls driving of the motor MT of the turbomolecular pump 2 in accordance with command signals from the main controller 10, and also outputs a later-described process signal to the abatement device controller 49 at predetermined timings. For example, control signals (processing start signals, processing stop signals, etc.) for CVD processing, etching processing, and so forth, within the process chamber 1 are input to the TMP controller 29. Upon such control signals being input, the TMP controller 29 drives or stops the motor MT of the turbomolecular pump 2.

Although omitted from illustration, the TMP controller 29 includes hardware including a central processing unit (CPU) that performs various types of computation and so forth, storage devices such as read-only memory (ROM), a hard disk drive (HDD), and so forth, that store programs by which the CPU executes computation, random-access memory (RAM) serving as a work region for the CPU to execute the programs, and a communication interface that is an interface used for exchanging data with other equipment, and software that is stored in the storage devices and executed by the CPU. The functions of the controller are realized by the CPU loading the various types of programs stored in the storage devices to the RAM and executing the programs. Details of control of the motor MT by the TMP controller 29 will be described later.

Figure 3:
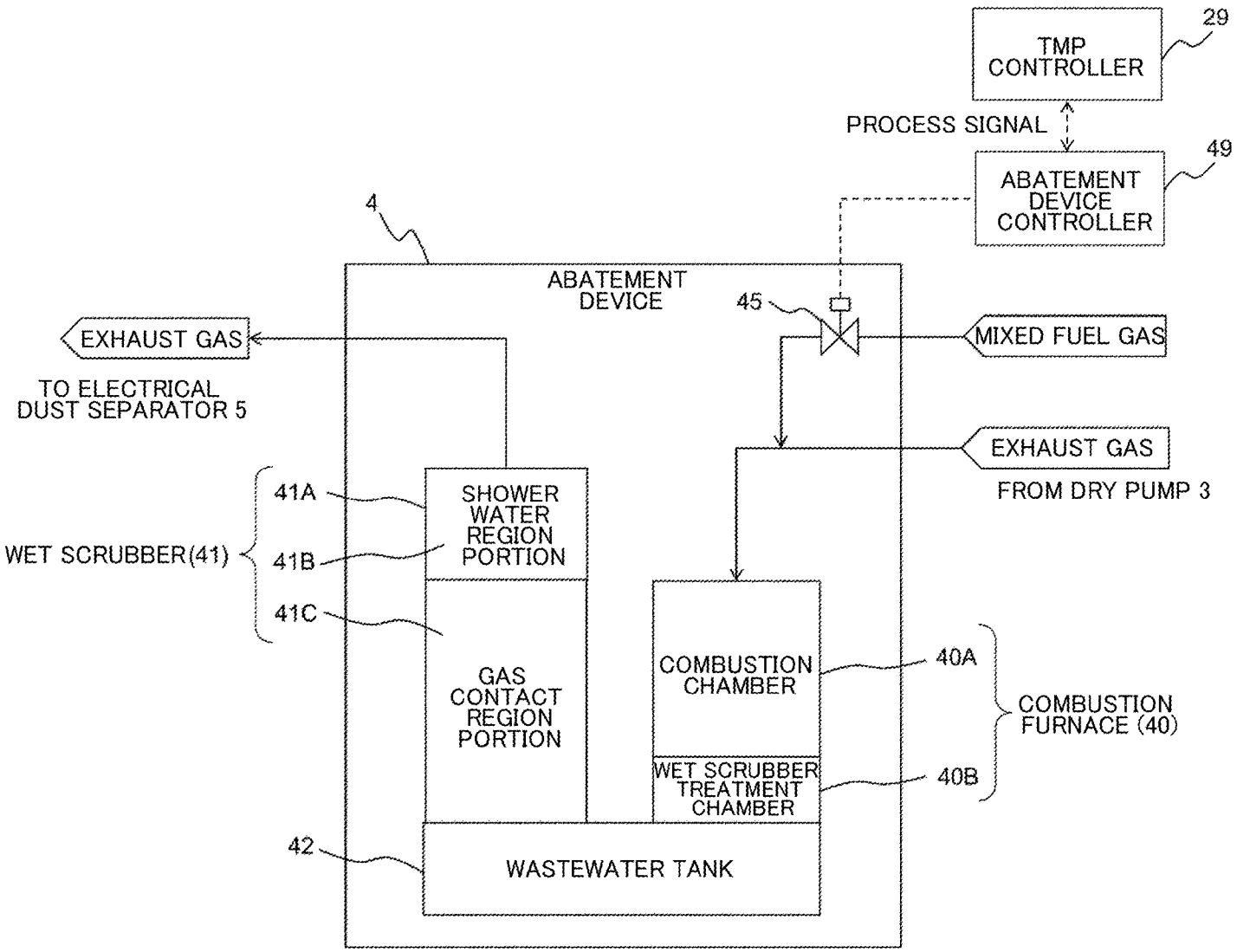
FIG. 3 is a configuration diagram illustrating details of an abatement device.

FIG. 3 is a configuration diagram illustrating details of the abatement device 4. As illustrated in FIG. 3, the abatement device 4 includes a combustion furnace 40, a wet scrubber 41, a wastewater tank 42, and a solenoid valve 45. The combustion furnace 40 includes a combustion chamber 40A into which exhaust gas, exhausted from the process chamber 1 and guided via the turbomolecular pump 2 and the dry pump 3 flows, and a wet scrubber treatment chamber 40B. Also, mixed fuel gas made up of fuel and air is guided into the combustion furnace 40 via the solenoid valve 45. Note that methane or propane gas is commonly used for the fuel gas.

The exhaust gas is subjected to combustion decomposition at high temperatures in the combustion chamber 40A. The exhaust gas following combustion decomposition flows into the wet scrubber treatment chamber 40B. Shower water is sprayed in the wet scrubber treatment chamber 40B, and the exhaust gas following combustion decomposition is passed through this shower water spray region, thereby removing harmful substances from the exhaust gas following combustion decomposition, such as capturing dust in the exhaust gas (e.g., silica powder generated by combustion composition of silane, or the like) by the shower water, collecting gas components in the exhaust gas that are readily dissolved in water (e.g., hydrofluoric acid generated by combustion decomposition of nitrogen trifluoride used as a cleaning gas in the process chamber 1) by the shower water, and so forth. The removed harmful substances flow into the wastewater tank 42 along with the wastewater from the shower water.

The wet scrubber 41 is provided downstream of the combustion furnace 40. The wet scrubber 41 has a shower water region portion 41B, and a gas contact region portion 41C provided with ring-like infills taking into consideration increase in surface area thereof, which are provided on an inner side of a cylindrical scrubber housing case 41A, and also is configured such that gas treated at the combustion chamber 40A and the wet scrubber treatment chamber 40B (exhaust gas following combustion decomposition and wet dedusting) flows therein from a lower portion of the cylindrical scrubber housing case 41A. The shower water of the shower water region portion 41B is also supplied to the gas contact region portion 41C by dripping. The exhaust gas following combustion decomposition and wet dedusting that has flowed into the cylindrical scrubber housing case 41A passes through the gas contact region portion 41C and flows into the shower water region portion 41B above. At this time, dust in the exhaust gas is captured by contact with portions provided with the ring-like infills taking into consideration the increase in surface area of the gas contact region portion 41C, and with shower water of the shower water region portion 41B.

The wastewater tank 42 recovers and pools the wastewater from the wet scrubber treatment chamber 40B and the wet scrubber 41. Also, a channel through which the exhaust gas flows is formed above a water surface in the wastewater tank 42. Accordingly, the exhaust gas guided into the abatement device 4 passes through the combustion chamber 40A, the wet scrubber treatment chamber 40B, above the water surface in the wastewater tank 42, and the wet scrubber 41, in that order, and is fed to the electrical dust separator 5.

The process signal (specific signal) is input to the abatement device controller 49 from the TMP controller 29, and actions (operations) of the abatement device 4 are controlled on the basis of this process signal. Specifically, while the process signal is being input, the abatement device controller 49 opens the solenoid valve 45, and performs control thereof to supply the mixed fuel gas toward the combustion chamber 40A. Note that hardware and software configurations of the abatement device controller 49 are the same as those of the TMP controller 29, and accordingly detailed description thereof will be omitted.

Figure 4:
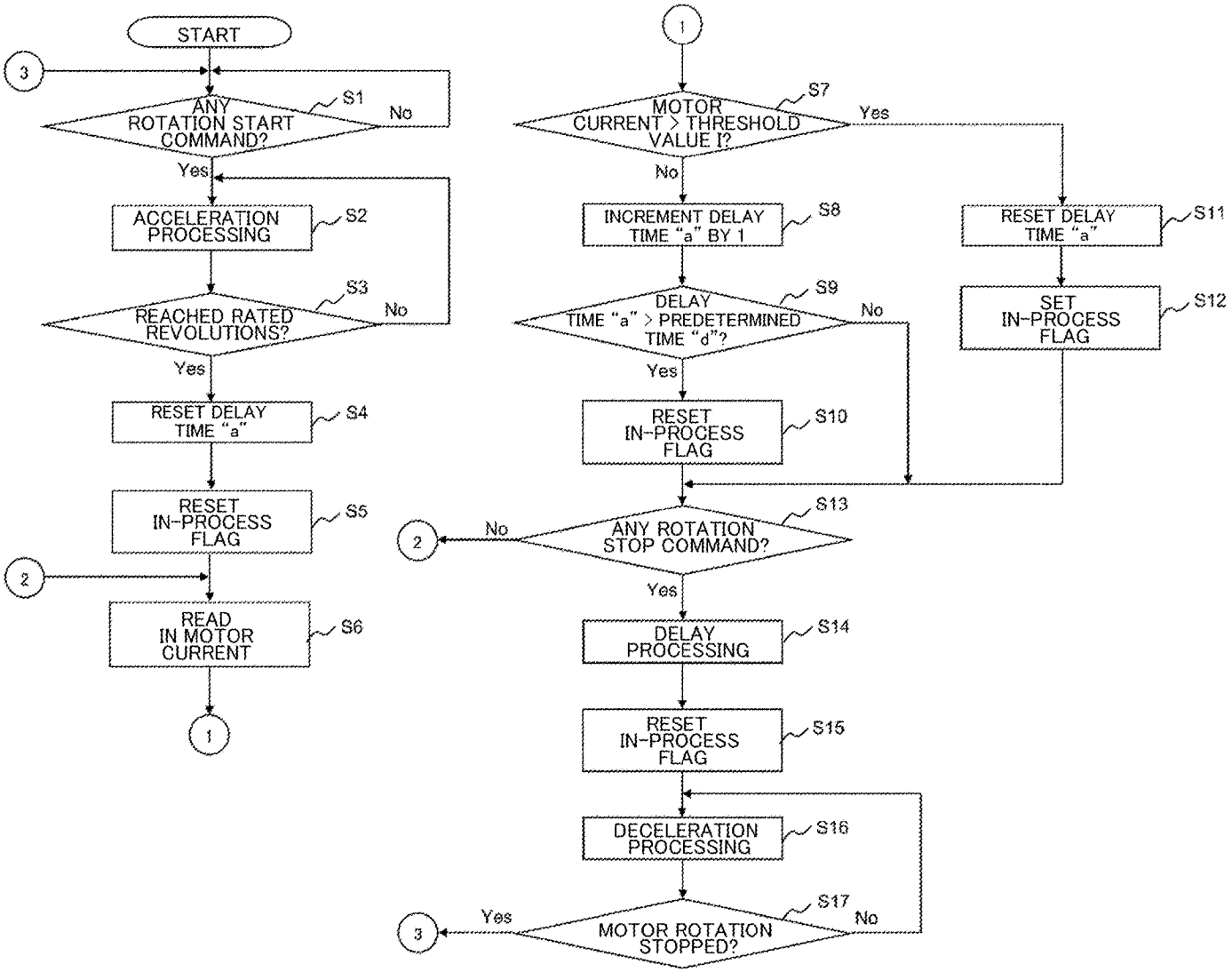
FIG. 4 is a flowchart showing procedures of control processing by a turbomolecular pump (TMP) controller.

Next, control of the turbomolecular pump 2 will be described with reference to FIG. 4. FIG. 4 is a flowchart showing procedures of control processing by the TMP controller 29. The TMP controller 29 monitors a state (revolutions and current values) of the motor MT at all times, and starts the control processing shown in FIG. 4 upon an operation start command for the turbomolecular pump 2 being input to the TMP controller 29.

First, the TMP controller 29 determines whether or not a rotation start command for the motor MT has been input (step S1). In a case in which a rotation start command for the motor MT has been input, (Yes in step S1), the TMP controller 29 performs acceleration processing of the motor MT (step S2), and when the motor MT reaches rated revolutions (Yes in step S3), resets delay time "a" (step S4), and resets an in-process flag (step S5).

Subsequently, the TMP controller 29 reads in the current of the motor MT (step S6), and determines a magnitude relation between the motor current and a threshold value I (predetermined threshold value) (step S7). In a case in which the motor current is no greater than the threshold value I (No in step S7), the TMP controller 29 adds "1" to the delay time "a" (step S8), and determines a magnitude relation between the delay time "a" and a predetermined amount of time "d" (step S9). In a case in which the delay time "a" is greater than the predetermined amount of time "d" (Yes in step S9), the TMP controller 29 resets the in-process flag (step S10), and sets output of the process signal to OFF. Conversely, in a case in which the delay time "a" is no greater than the predetermined amount of time "d", the TMP controller 29 skips the processing of step S10 and transitions to step S13.

In a case in which the motor current exceeds the threshold value I in the determination in step S7 (Yes in step S7), the flow advances to step S11, the TMP controller 29 resets the delay time "a" (step S11), and sets the in-process flag (step S12). Once the in-process flag is set, the TMP controller 29 sets output of the process signal to ON. The flow then advances to step S13.

In a case in which the motor current exceeds the threshold value, I, during normal operations of the motor MT, i.e., during process processing, the processing of Yes in step S7→step S11→step S12→No in step S13→step S6→Yes in step S7 is repeated, thereby continuing output of the process signal. When the motor current is no greater than the threshold value I, the delay time "a" is added in step S8, after which the flow cannot advance to step S10 until the delay time "a" exceeds the predetermined amount of time "d" in step S9, and accordingly the in-process flag is not reset. That is to say, output of the process signal is continued until the predetermined amount of time "d" elapses after the process processing is ended and the motor current is no longer greater than the threshold value I. According to this processing the abatement device 4 continues operations even after the process processing ends, until the predetermined amount of time "d" elapses.

Next, the TMP controller 29 determines whether or not a rotation stop command for the motor MT has been input (step S13), and in a case in which a rotation stop command for the motor MT has been input (Yes in step S13), performs delay processing (step S14), resets the in-process flag (step S15), and performs deceleration processing of the motor MT (step S16). Subsequently, the TMP controller 29 determines whether or not rotation of the motor MT is actually stopped, on the basis of revolution detection signals from an unshown revolution detection sensor of the motor MT (step S17). In a case in which the rotation of the motor MT is stopped, the TMP controller 29 returns to step S1. In a case in which the rotation of the motor MT is not stopped, the TMP controller 29 returns to step S16, and executes deceleration processing of the motor MT (step S16).

Conversely, in a case in which a rotation stop command for the motor MT has not been input in step S13 (No in step S13), the flow returns to step S6. In a case of No in step S1, the TMP controller 29 stands by at step S1 until a rotation start command for the motor MT is input, and in a case of No in step S3, returns to step S2.

Figure 5:
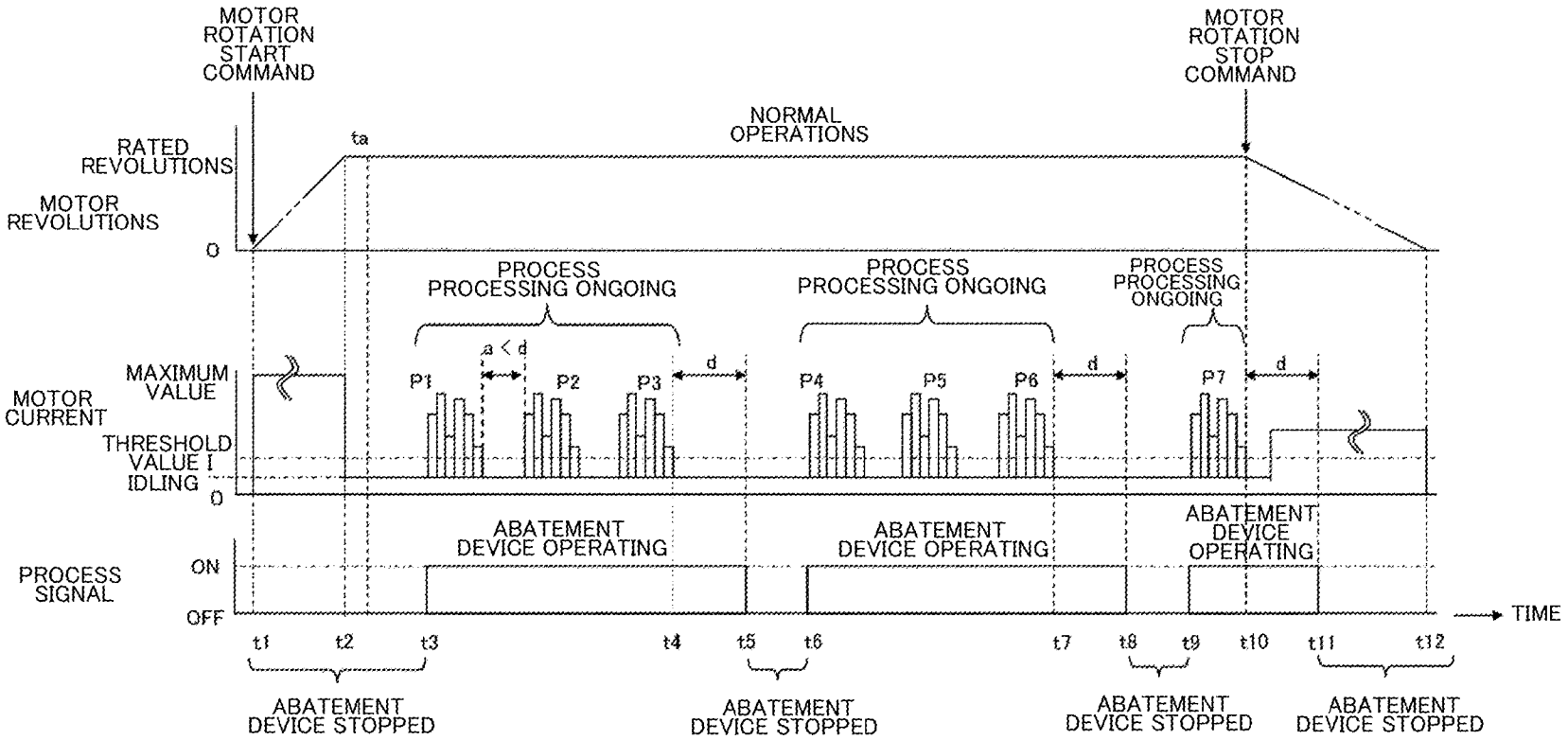
FIG. 5 is a timing chart showing change in motor revolutions, motor current, and output of a process signal, along with elapse of time, from starting to stopping rotation of a motor of the turbomolecular pump.

Next, the operation state of the motor MT, change in current values of the motor MT, and ON/OFF states of process signal output from the TMP controller 29 to the abatement device controller 49, will be described with reference to FIG. 5. FIG. 5 is a timing chart showing change in motor revolutions, motor current, and output of the process signal, along with elapse of time, from starting to stopping of rotation of the motor MT of the turbomolecular pump 2.

(a) Change in Revolutions of Motor MT

Upon a motor rotation start command being input to the TMP controller 29 at time t1, the TMP controller 29 starts rotation of the motor MT of the turbomolecular pump 2. The motor MT accelerates, and the revolutions of the motor MT increase (see step S2 in FIG. 4). The revolutions of the motor MT then reach the rated revolutions at time t2 (see step S3 in FIG. 4). When the revolutions of the motor MT reach the rated revolutions, the revolutions of the motor MT are maintained constant. That is to say, from time t2 to time t10, normal operations are performed in which the revolutions of the motor MT are maintained at the rated revolutions. Upon a motor rotation stop command being input to the TMP controller 29 at time t10 (see Yes in step S13 in FIG. 4), the motor MT of the turbomolecular pump 2 decelerates (see step S16 in FIG. 4), and finally comes to a stop at time t12 (see Yes in step S17 in FIG. 4).

(b) Change in Current of Motor MT

At time t1 at which the motor rotation start command is input to the TMP controller 29, the current of the motor MT instantaneously rises to a maximum level, and the current of the motor MT is maintained at a maximum value until time t2 at which the revolutions of the motor MT then reach the rated revolutions. Then at time t2, the current of the motor MT decreases to a value for when idling.

When process processing is performed in the process chamber 1 during the period in which the motor MT is performing normal operations (time t2 to time t10), exhaust gas is exhausted from the process chamber 1 in conjunction with the process processing. The motor load of the turbomolecular pump 2 rises to take in and discharge the exhaust gas, and the motor current temporarily rises. For example, when process processing is performed at points in time P1 to P7 in FIG. 5, the rise in the motor current is such that rises in accordance with the load, within a range from current when the motor MT is idling to less than the maximum value of the motor current. In the present example, the threshold value I is set to a value that is greater than the current in a state in which the motor MT is idling and smaller than the maximum value of the motor current, e.g., set to around 25% of the maximum value of the motor current. Accordingly, during process processing, the motor current is in a state exceeding the threshold value I. In other words, when the motor current value exceeds the threshold value I, process processing can be surmised to be ongoing.

(c) ON/OFF of Process Signal

During the period from the motor MT starting rotation, reaching the rated revolutions, and the process processing being started at the process chamber 1 (time t1 to time t3), the process signal (specific signal) remains OFF (see step S5 in FIG. 4). While the motor MT is operating at the rated revolutions (normal operations), the process signal goes ON at the timing of time t3 at which the motor current value is in a state of exceeding the threshold value I (specific state), and the process signal is output from the TMP controller 29 to the abatement device controller 49 (see step S12 in FIG. 4). Upon the process signal being input, the abatement device controller 49 opens the solenoid valve 45 to guide the mixed fuel gas to the combustion chamber 40A, and performs abatement treatment of the exhaust gas.

Thereafter, when the predetermined amount of time "d" elapses from time t4 at which the process processing ends, the process signal is switched to OFF. That is to say, the process signal is ON from time t3 at which the process processing starts to time t5 at which the predetermined amount of time "d" has elapsed after the process processing ending (times t3 to t5). Accordingly, the abatement device 4 is operated from time t3 to time t5, and operations of the abatement device 4 are stopped after time t5. Upon process processing starting at time t6, the process signal goes ON again, the abatement device 4 starts operations, and upon the process signal going to OFF at time t8, operations of the abatement device 4 are stopped.

Now, in the present example, the expression "operations of the abatement device 4 are stopped" includes both completely stopping operations of the abatement device 4, and setting the abatement device 4 to a standby operation mode (standby operation state) and stopping performing abatement treatment of exhaust gas. That is to say, it is sufficient for at least abatement treatment (abatement operations) by the abatement device 4 to be stopped. Note that in the standby operation mode, the abatement device 4 is in a state in which the amount of consumption of the above-described mixed fuel gas is suppressed, while maintaining a minimally combustion state.

Also, upon process processing starting at time t9, the process signal goes ON, and the process signal goes OFF at time t11, after the predetermined amount of time "d" has elapsed from time t10 at which the motor rotation stop command is input to the TMP controller 29. That is to say, the abatement device 4 is operated until the predetermined amount of time "d" has elapsed from the motor rotation stop command.

Now, the predetermined amount of time "d" is set taking into consideration the amount of time needed for the exhaust gas to flow from the turbomolecular pump 2 to the abatement device 4. For example, in a case in which the amount of time for exhaust gas exhausted from the turbomolecular pump 2 to be completely guided into the abatement device 4 is ten seconds, the predetermined amount of time "d" is set to twelve seconds, which is somewhat longer than ten seconds. This is to perform abatement of the exhaust gas exhausted from the turbomolecular pump 2 by the abatement device 4 in a sure manner.

According to the exhaust gas treatment system configured as described above, the following effects and advantages can be yielded.

The TMP controller 29 that controls the turbomolecular pump 2 can detect that process processing is ongoing in a sure manner, on the basis of the current value of the motor MT (state of motor MT), and accordingly, there is no need for the main controller 10 or some other controller to input a signal to the TMP controller 29 to the effect that process processing is ongoing.

Further, the abatement device controller 49 can perform control such that the abatement device 4 is operated only while process processing is ongoing, on the basis of the process signal input from the TMP controller 29. Accordingly, there is no need to supply the mixed fuel gas to the abatement device 4 at all times. Specifically, the solenoid valve 45 can be opened to supply the mixed fuel gas to the combustion furnace 40 only while process processing is ongoing. Accordingly, mixed fuel gas can be prevented from being wastefully supplied to the abatement device 4, and energy-conserving operation of the abatement device 4 can be realized. In the example in FIG. 5, operations of the abatement device 4 can be stopped from times t1 to t3, times t5 to t6, times t8 to t9, and times t11 to t12, and accordingly, marked energy conservation effects can be anticipated as compared to a case of operating the abatement device 4 from times t1 to t12.

Also, the delay time "a" is provided for the process signal going OFF, and the delay time "a" takes into consideration the amount of time for the exhaust gas exhausted from the turbomolecular pump 2 to be guided to the abatement device 4 (predetermined amount of time "d") in a sure manner. Accordingly, the exhaust gas exhausted from the turbomolecular pump 2 can be guided to the abatement device 4 and subjected to abatement in a sure manner. Moreover, it is sufficient for operations of the abatement device 4 to be controlled on the basis of the process signal from the TMP controller 29 alone, and accordingly, control processing of the abatement device controller 49 is simple. Also, control can be performed just by signal input/output between the TMP controller 29 and the abatement device controller 49, and accordingly there is an advantage in that control of the exhaust gas treatment system can be simplified.

Modification of First Example

A configuration may be made in the example described above in which output of the process signal is forbidden for a specific time "ta" from time t2, as shown in FIG. 5. Immediately after the motor MT reaching the rated revolutions, the motor current fluctuates, and accordingly there is a possibility of the motor current exceeding the threshold value I even though process processing is not ongoing. Even in such a case, forbidding output of the process signal for the specific time "ta" prevents operation of the abatement device 4 from being performed even though process processing is not ongoing, further enabling energy-conserving operation. Note that it is sufficient for the specific time "ta" to be of a duration such that fluctuation of the motor current becomes small, and may be around ten seconds, for example.

Second Example

Next, an exhaust gas treatment system according to a second example of the present disclosure will be described. The second example differs from the first example with regard to the point that the first example is a configuration in which one abatement device 4 is installed for one turbomolecular pump 2, but the second example is a configuration in which one abatement device 4 is installed for a plurality of turbomolecular pumps. Accordingly, the control method of the abatement device 4 according to the second example differs from that in the first example. The second example will be described below mainly regarding this point of difference.

Figure 6:
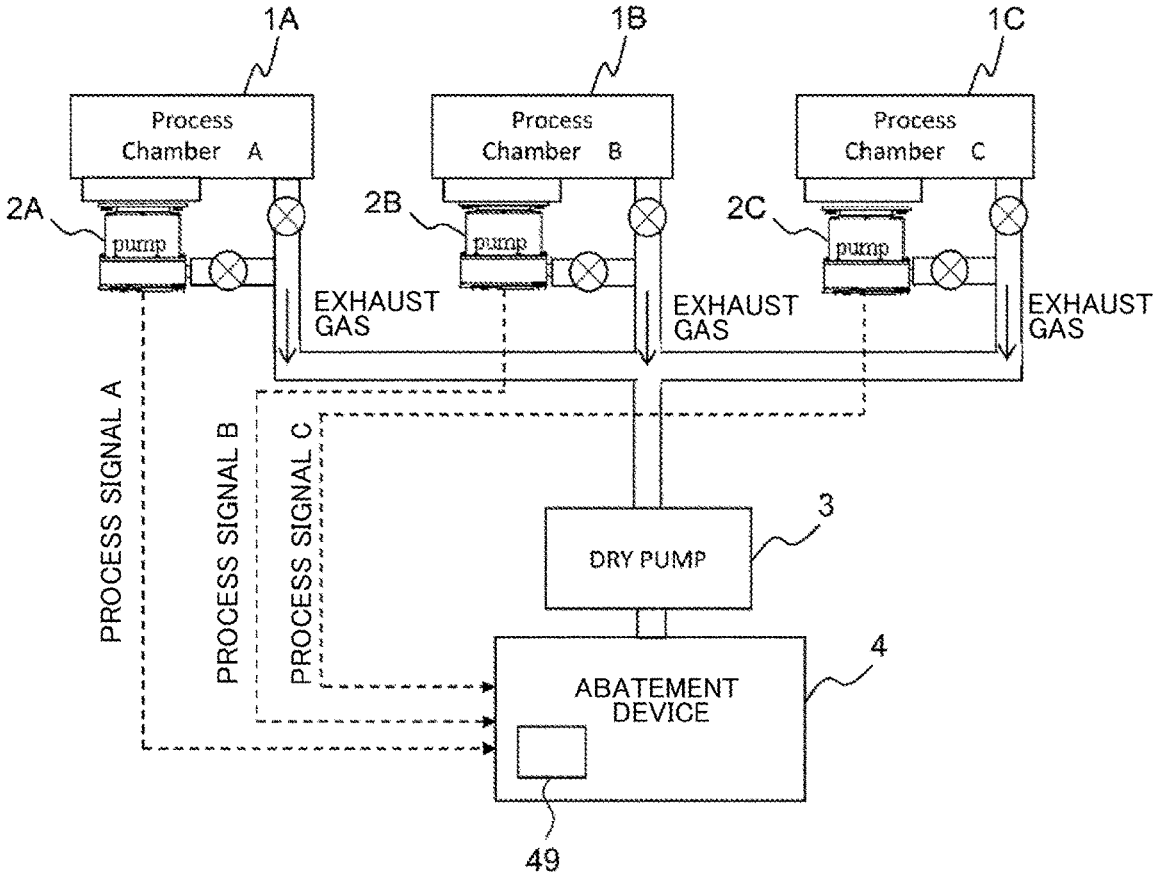
FIG. 6 is an overall configuration diagram of an exhaust gas treatment system according to a second example of the present disclosure.

FIG. 6 is an overall configuration diagram of the exhaust gas treatment system according to the second example of the present disclosure. As illustrated in FIG. 6, in the configuration according to the second example, turbomolecular pumps 2A, 2B, and 2C are installed with respect to process chambers 1A, 1B, and 1C, and the dry pump 3 and the abatement device 4 are installed downstream of the three turbomolecular pumps 2A, 2B, and 2C. Note that the electrical dust separator 5 and the central scrubber 6 are omitted from illustration in FIG. 6.

Respective process signals A, B, and C are input from respective TMP controllers (omitted from illustration) of the turbomolecular pumps 2A, 2B, and 2C to the abatement device controller 49 of the abatement device 4. ON/OFF of the process signals A, B, and C is the same as in the first example (see FIGS. 4 and 5). The abatement device controller 49 controls operation of the abatement device 4 on the basis of the process signals A, B, and C.

In the second example, four stages are set in advance for the operation levels of the abatement device 4. Operation level 0 is operation stopped, operation level 1 is operating at 33% load, operation level 2 is operating at 66% load, and operation level 3 is operating at 100% load. This is due to one abatement device 4 being installed with respect to the three process chambers 1A, 1B, and 1C, and accordingly the operation levels of the abatement device 4 are set to the four stages of operation stopped (including standby operation), 33% load, 66% load, and 100% load.

Note that in the second example, the difference in the operating level is the difference in a flowrate of the mixed fuel gas supplied to the abatement device 4. For example, operation level 1 is operation in which an opening degree of the solenoid valve 45 (see FIG. 3) is set to a predetermined opening degree (e.g., 33%), and the flowrate of the mixed fuel gas is approximately 33% of that of operating at 100% load. The same is true for operating level 2 as well.

The abatement device controller 49 then performs control to operate the abatement device 4 by switching the operation level in accordance with an input count (total count) of process signals. Specifically, the control program is created such that in a case in which operation level 0 (abatement operation stopped) is selected when the input count of process signals is zero, operation level 1 when one, operation level 2 when two, and operation level 3 when three.

Figure 7:
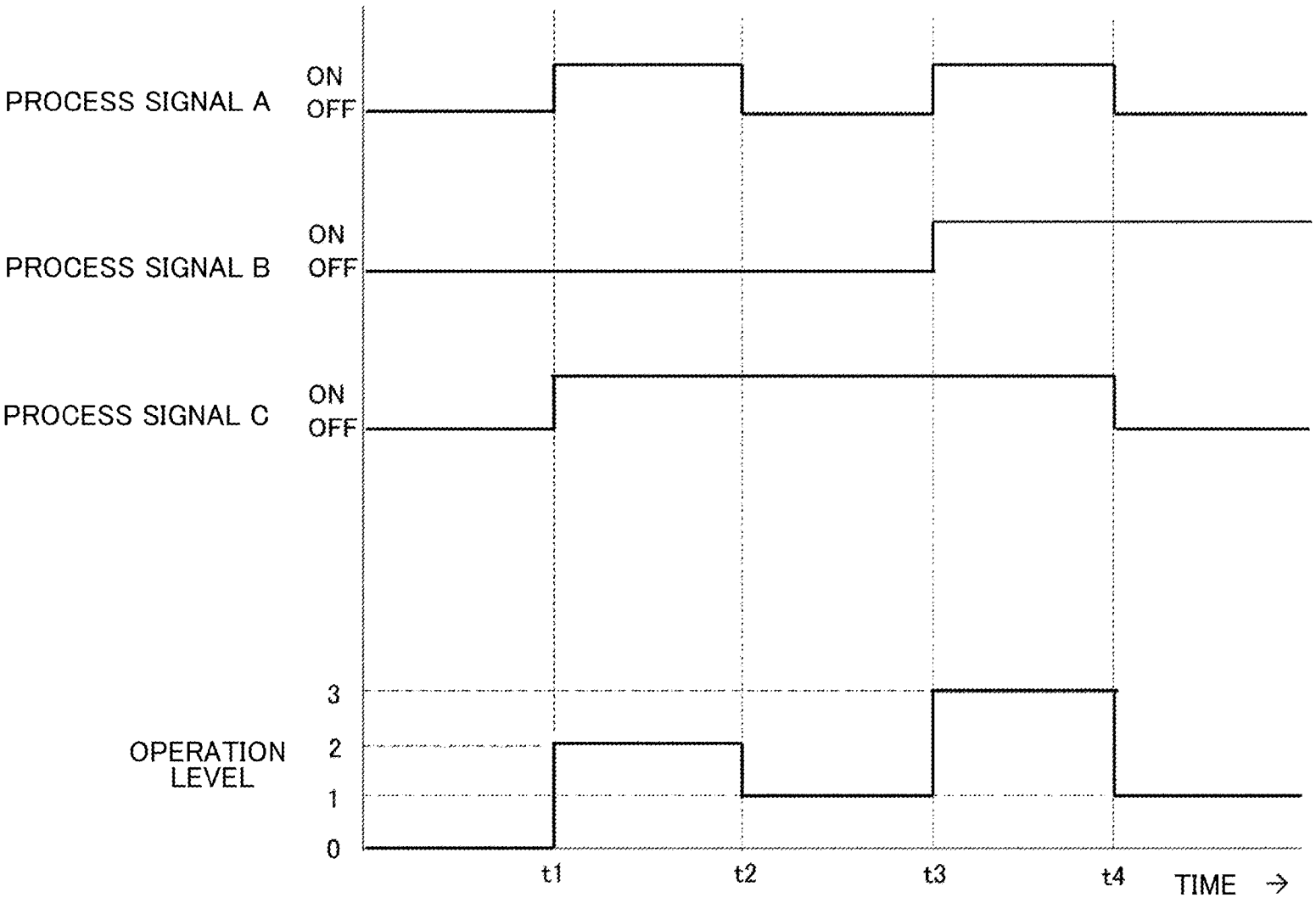
FIG. 7 is a timing chart showing change in operating state of an abatement device.

FIG. 7 is a timing chart showing change in operating states of the abatement device 4. As shown in FIG. 7, when all of process signals A, B, and C are OFF, the input count of process signals is zero, and accordingly the abatement device controller 49 stops operation of the abatement device 4.

Upon process signal A and process signal C going ON and being input to the abatement device controller 49 at time t1, the input count of process signals is two, and the abatement device controller 49 operates the abatement device 4 at operating level 2 (66% load).

Upon process signal A going OFF at time t2, the input count of process signals is one, and accordingly the abatement device controller 49 operates the abatement device 4 at operating level 1 (33% load).

Upon all of process signals A, B, and C going ON at time t3, the input count of process signals is three, and accordingly the abatement device controller 49 operates the abatement device 4 at operating level 3 (100% load).

Upon process signal A and process signal C going OFF at time t4, the input count of process signals is one, and accordingly the abatement device controller 49 operates the abatement device 4 at operating level 1 (33% load).

In this way, according to the second example, wasteful consumption of mixed fuel gas can be suppressed, and energy-conserving operation of the abatement device 4 can be realized, in the same way as with the first example. Also, in a case in which there is no input of process signals, operation of the abatement device 4 can be stopped (operating level 0), and accordingly the energy conservation effects are high. Moreover, an advantage of being able to reduce the number of abatement devices 4 is anticipated.

Also, in a case in which ambient atmosphere flows through the system of the exhaust gas treatment system, the ambient atmosphere flows from the process chambers 1A, 1B, and 1C to the abatement device 4, bypassing the turbomolecular pumps 2A, 2B, and 2C. In this case, the turbomolecular pumps 2A, 2B, and 2C are in an idling state, the motor current value does not exceed the threshold value I (see FIG. 5), and the process signals remain OFF. Accordingly, no process signals are input to the abatement device controller 49, and the abatement device 4 is not wastefully operated. That is to say, according to the present example, the abatement device 4 is operated only while process processing is ongoing, and operation of the abatement device 4 can be stopped in a case in which ambient atmosphere flows through the system, and accordingly energy conservation effects are anticipated.

Modification of Second Example

In the second example described above, the operation level of the abatement device 4 is changed on the basis of the input count of process signals input to the abatement device controller 49. An arrangement may be made instead of this configuration, in which current values of the motors MT of the turbomolecular pumps 2A, 2B, and 2C are input to the abatement device controller 49, the abatement device controller 49 totals the current values of the motors MT, and changes the operation level of the abatement device 4 on the basis of a total value.

In this case, the abatement device controller 49 determines whether the total value of motor currents is (a) a value equivalent to an idling state, (b) exceeds the value equivalent to an idling state and is no greater than a threshold value Ia, (c) exceeds the threshold value Ia and is no greater than a threshold value Ib, or (d) exceeds the threshold value Ib and is no greater than a threshold value Ic, and decides the operation level on the basis of the determination results.

Note that the threshold value Ia is set to a value somewhat higher than a value equivalent to the current flowing at the motor of one turbomolecular pump while process processing is ongoing, the threshold value Ib is set to a value somewhat higher than a value equivalent to a total value of currents flowing at the motors of two turbomolecular pumps while process processing is ongoing, and the threshold value Ic is set to a value somewhat higher than a value equivalent to a total value of currents flowing at the motors of three turbomolecular pumps while process processing is ongoing.

Figure 8:
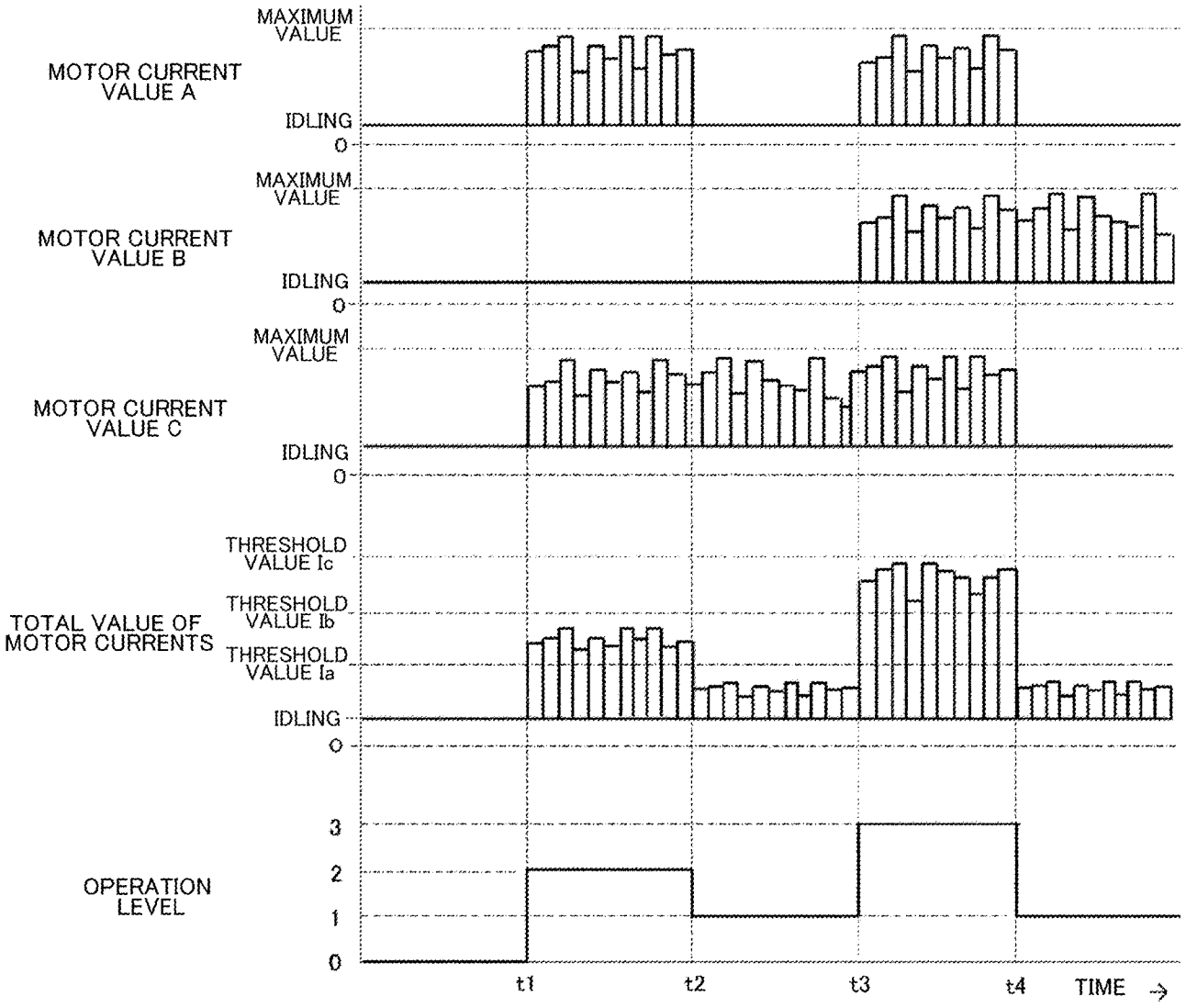
FIG. 8 is a timing chart showing change in operating state of an abatement device (modification).

FIG. 8 is a timing chart showing change in operating states of the abatement device 4 according to a modification. As shown in FIG. 8, initially, the total value of the motor current values A, B, and C is a value equivalent to an idling state, and accordingly, the abatement device controller 49 stops operation of the abatement device 4 (operation level 0).

At time t1, the total value of the motor current values A, B, and C exceeds the threshold value Ia and is no greater than the threshold value Ib, and accordingly the abatement device controller 49 operates the abatement device 4 at operation level 2 (66% load).

At time t2, the total value of the motor current values A, B, and C exceeds the value equivalent to an idling state and is no greater than the threshold value Ia, and accordingly the abatement device controller 49 operates the abatement device 4 at operation level 1 (33% load).

At time t3, the total value of the motor current values A, B, and C exceeds the threshold value Ib and is no greater than the threshold value Ic, and accordingly the abatement device controller 49 operates the abatement device 4 at operation level 3 (100% load).

At time t4, the total value of the motor current values A, B, and C exceeds the value equivalent to an idling state and is no greater than the threshold value Ia, and accordingly the abatement device controller 49 operates the abatement device 4 at operation level 1 (33% load).

Energy-conserving operation of the abatement device 4 can be performed in the same way as with the second example, by using motor current values as in this modification. This modification changes the operation level on the basis of motor current values, and accordingly, even in a case in which the processing capabilities of the process chambers 1A, 1B, and 1C differ from each other, the abatement device 4 can be operated suitably by setting the threshold values Ia, Ib, and Ic appropriately.

It should be noted that the present disclosure is not limited to the above-described examples, various modifications can be made without departing from the spirit and scope of the present disclosure, and all technical matters encompassed by the technological concept described in the Claims are an object of the present disclosure. Although the examples show preferred examples, one skilled in the art will be able to realize various substitutions, alterations, modifications, and improvements, from the content disclosed in the present specifications, and these are encompassed by the technical scope described in the attached Claims.

For example, the abatement device 4 is not limited to the combustion type described above, and a plasma type or other types may be employed. In a case of a plasma type abatement device for example, electric power consumption at a plasma generating device can be reduced.

What is claimed is:

1. A vacuum pump that sucks in and exhausts exhaust gas, the vacuum pump comprising:

a motor serving as a drive source; and a first controller that controls driving of the motor, wherein the first controller monitors a state of the motor, and in a case in which the state of the motor is a specific state, outputs a specific signal to an external entity, the specific state: excludes when starting up and when stopped, is a state in which the motor is in normal operations, and a current of the motor exceeds a predetermined threshold value, and the first controller:

outputs the specific signal to the external entity while the current of the motor exceeds the predetermined threshold value, and maintains output of the specific signal to the external entity until a predetermined amount of time elapses after the current of the motor becomes no greater than the predetermined threshold value.

2. The vacuum pump according to claim 1, wherein the predetermined amount of time is set to an amount of time exceeding an amount of time for the exhaust gas exhausted from the vacuum pump to reach an abatement device installed on a downstream side of the vacuum pump.

3. The vacuum pump according to claim 2, wherein the external entity is a second controller that controls actions of the abatement device.

4. The vacuum pump according to claim 1, wherein:

the first controller forbids output of the specific signal to the external entity until a specific amount of time elapses from a point in time at which the motor starts and reaches normal operations.

* * * * *